US010907807B1

(12) United States Patent
Hsu

(10) Patent No.: US 10,907,807 B1
(45) Date of Patent: Feb. 2, 2021

(54) CEILING LIGHT FIXTURE ASSEMBLED EASILY AND QUICKLY

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/508,349

(22) Filed: Jul. 11, 2019

(51) Int. Cl.
*F21V 21/03* (2006.01)
*F21V 17/16* (2006.01)
*F21S 8/04* (2006.01)

(52) U.S. Cl.
CPC ..... *F21V 21/03* (2013.01); *F21S 8/043* (2013.01); *F21V 17/164* (2013.01)

(58) Field of Classification Search
CPC ..... F21V 21/03; F21V 21/02; F21V 21/042; F21V 21/088; F21V 21/0885; F21V 17/164; F21S 8/043
USPC ..... 248/343, 344
See application file for complete search history.

(56) References Cited

U.S. PATENT DOCUMENTS 6,588,922 B1 * 7/2003 DeCicco ..... F21V 21/04 362/148
7,255,315 B2 * 8/2007 Oh ..... A62C 35/68 248/342
7,264,214 B2 * 9/2007 Oh ..... A62C 35/68 169/16
7,300,248 B2 * 11/2007 Wang ..... F04D 25/088 248/343
9,341,349 B1 * 5/2016 Moore ..... F21V 19/002
9,702,533 B1 * 7/2017 Harpenau ..... F21V 21/03
9,903,548 B2 * 2/2018 Creasman ..... F21V 21/03
9,921,364 B2 * 3/2018 Boulanger ..... G02B 6/0051
9,933,144 B2 * 4/2018 Mandy ..... F21V 21/046
9,958,120 B2 * 5/2018 Liu ..... F21S 8/026
10,168,029 B1 * 1/2019 Hsu ..... F21V 17/18
10,386,028 B2 * 8/2019 Xu ..... F21V 17/164
10,612,756 B1 * 4/2020 Hsu ..... F21V 21/03
2013/0037502 A1 * 2/2013 Gagne ..... F21V 21/048 211/71.01
2018/0202637 A1 * 7/2018 Sieczkowski ..... F21V 21/02
2020/0271281 A1 * 8/2020 Huang ..... F21K 9/61

* cited by examiner

*Primary Examiner* — Nkeisha Smith
(74) *Attorney, Agent, or Firm* — Alan D. Kamrath; Mayer & Williams PC

(57) ABSTRACT

A ceiling light fixture includes a mounting bracket, two retaining members pivotally mounted on two ends of the mounting bracket respectively, a light module mounted on the mounting bracket, and an outer disk mounted on the light module. The light module is retained by the two retaining members. The light module is provided with two connecting portions and a plurality of locking members. Each of the two connecting portions is provided with two retaining grooves locked onto one of the two retaining members. The outer disk is provided with a plurality of elastic plates. Each of the elastic plates of the outer disk is locked onto one of the locking members of the light module.

6 Claims, 5 Drawing Sheets

CEILING LIGHT FIXTURE ASSEMBLED EASILY AND QUICKLY

BACKGROUND OF THE INVENTION

1. Field of the Invention

The present invention relates to a lighting device and, more particularly, to a ceiling fitting or a ceiling light fixture.

2. Description of the Related Art

A conventional ceiling fitting is mounted on the ceiling of a house room to provide an illuminating function. In general, the conventional ceiling fitting is affixed to the ceiling by a plurality of fasteners, such as screws or expansion bolts, during the assembling process. However, operations of the fasteners easily do damage to the construction of the ceiling. In addition, it is difficult to operate the fasteners to mount the conventional ceiling fitting to the ceiling, such that the conventional ceiling fitting is not mounted easily, thereby causing inconvenience to the operator during assembly.

BRIEF SUMMARY OF THE INVENTION

The primary objective of the present invention is to provide a ceiling light fixture that has a greatly simplified construction and is assembled and disassembled easily and quickly.

In accordance with the present invention, there is provided a ceiling light fixture comprising a mounting bracket, two retaining members mounted on two ends of the mounting bracket respectively, a light module mounted on the mounting bracket, and an outer disk mounted on the light module. Each of the two retaining members is pivotally connected with the mounting bracket. Each of the two retaining members is rotated about the mounting bracket. The light module is retained by the two retaining members. The light module has a periphery provided with two connecting portions corresponding to the two retaining members respectively. Each of the two connecting portions of the light module is provided with two retaining grooves locked onto one of the two retaining members. The periphery of the light module is further provided with a plurality of locking members. The outer disk is provided with a plurality of elastic plates corresponding to the locking members of the light module respectively. Each of the elastic plates of the outer disk is locked onto one of the locking members of the light module.

According to the primary advantage of the present invention, the light module is secured to the mounting bracket, and the outer disk is affixed to the light module to finish assembly of the ceiling light fixture, such that the ceiling will not be damaged during installation of the ceiling light fixture.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
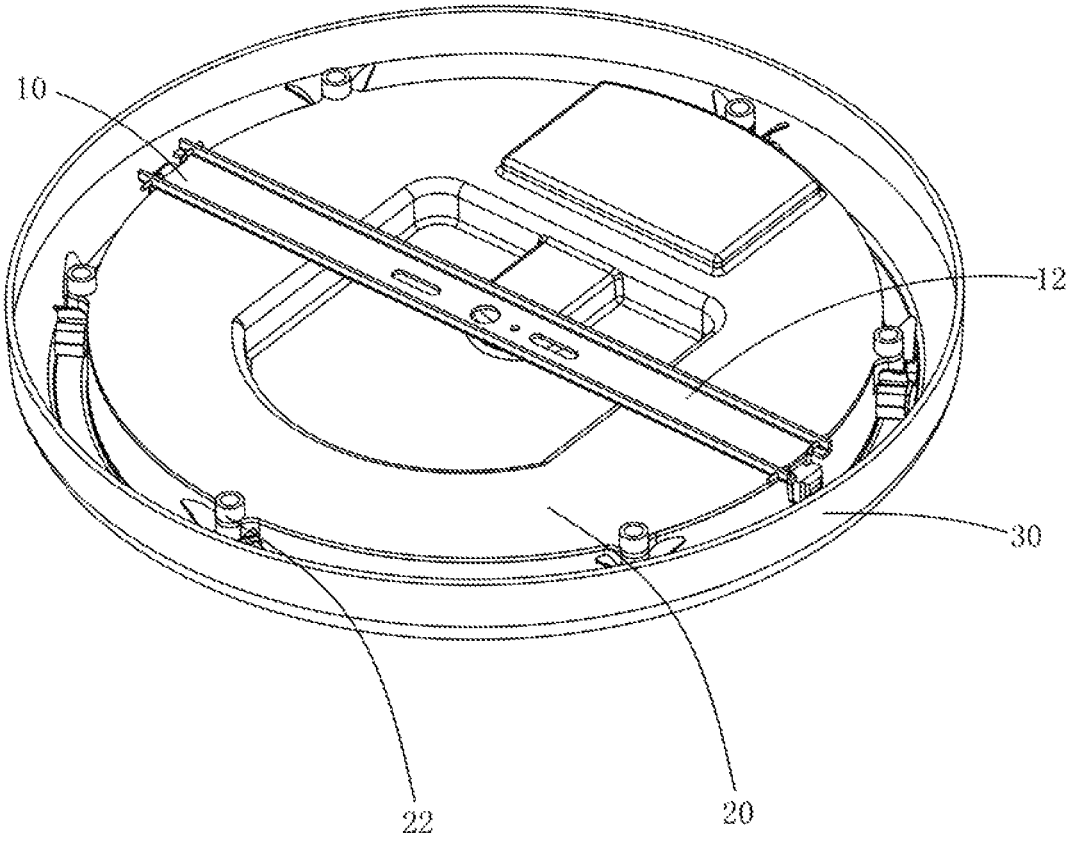
FIG. 1 is a perspective view of a ceiling light fixture in accordance with the preferred embodiment of the present invention.
Figure 2:
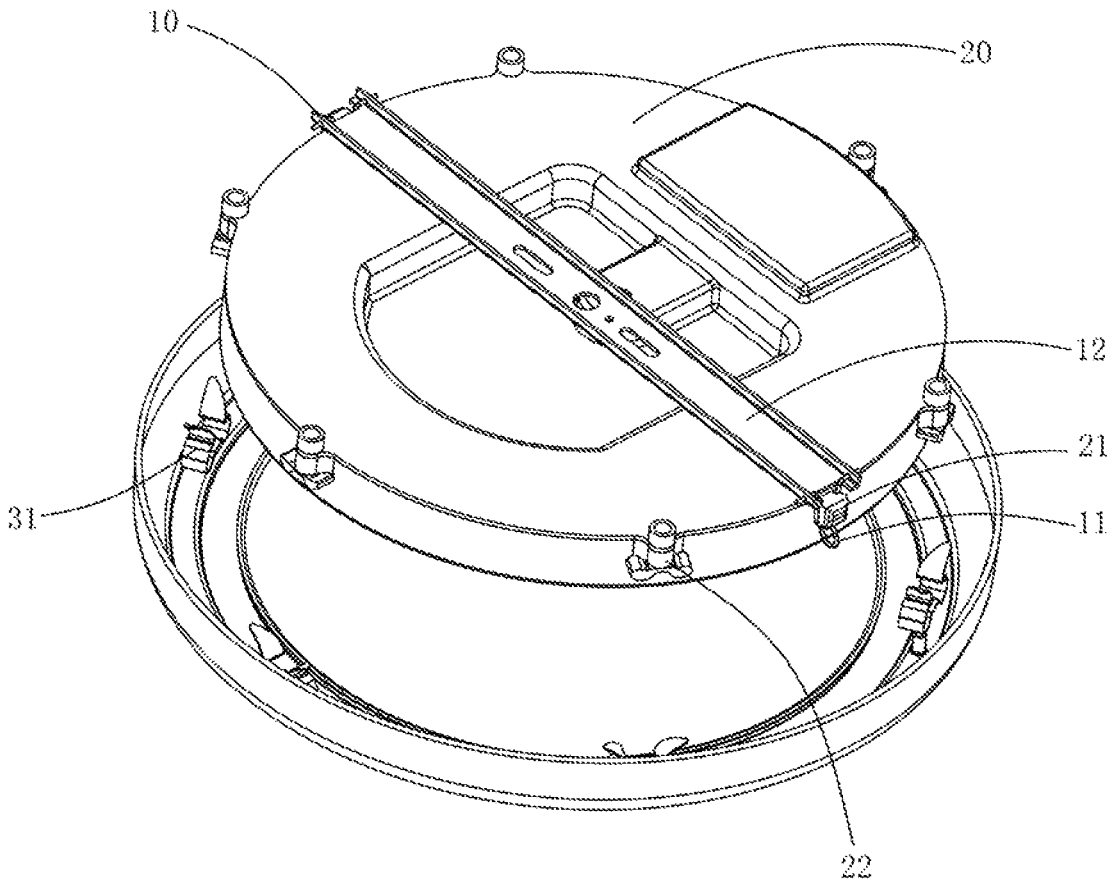
FIG. 2 is a partial exploded perspective view of the ceiling light fixture in accordance with the preferred embodiment of the present invention.
Figure 3:
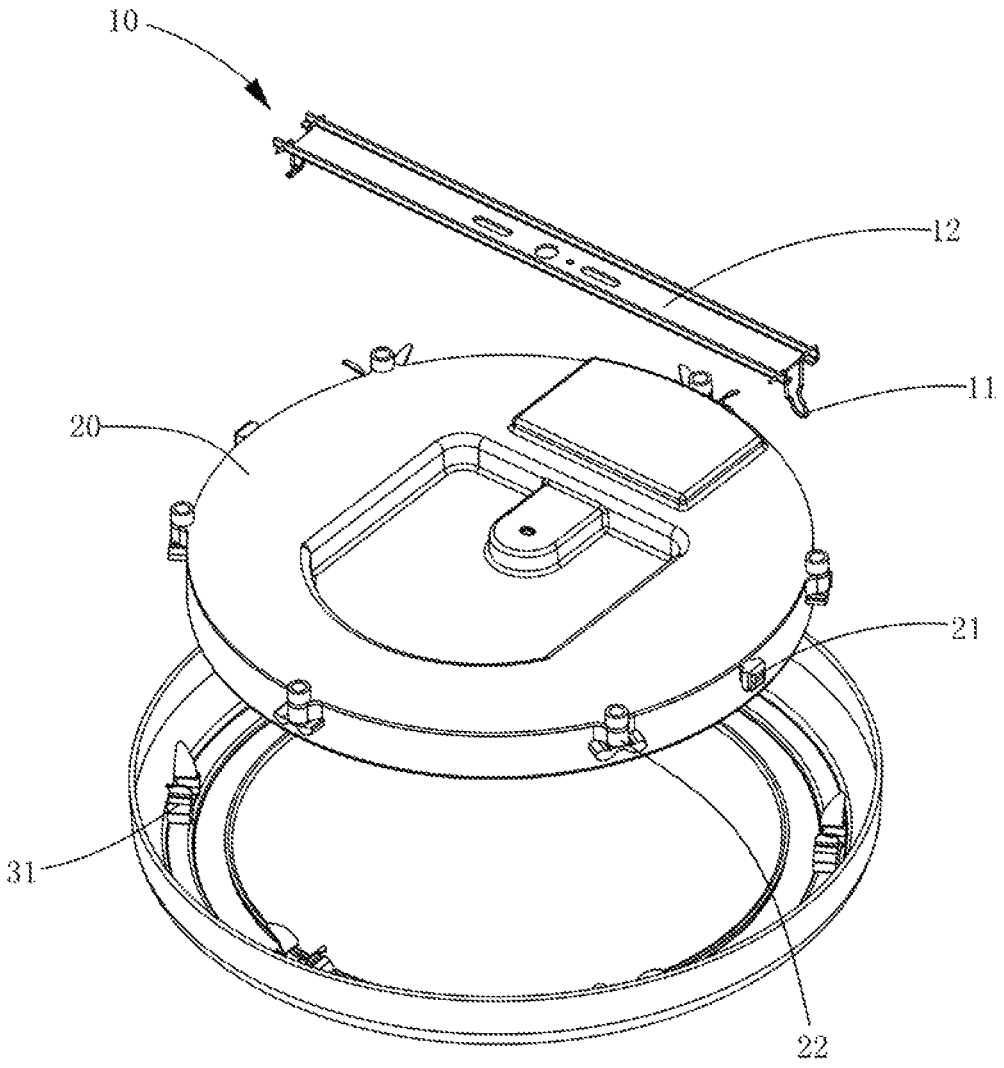
FIG. 3 is an exploded perspective view of the ceiling light fixture in accordance with the preferred embodiment of the present invention.
Figure 4:
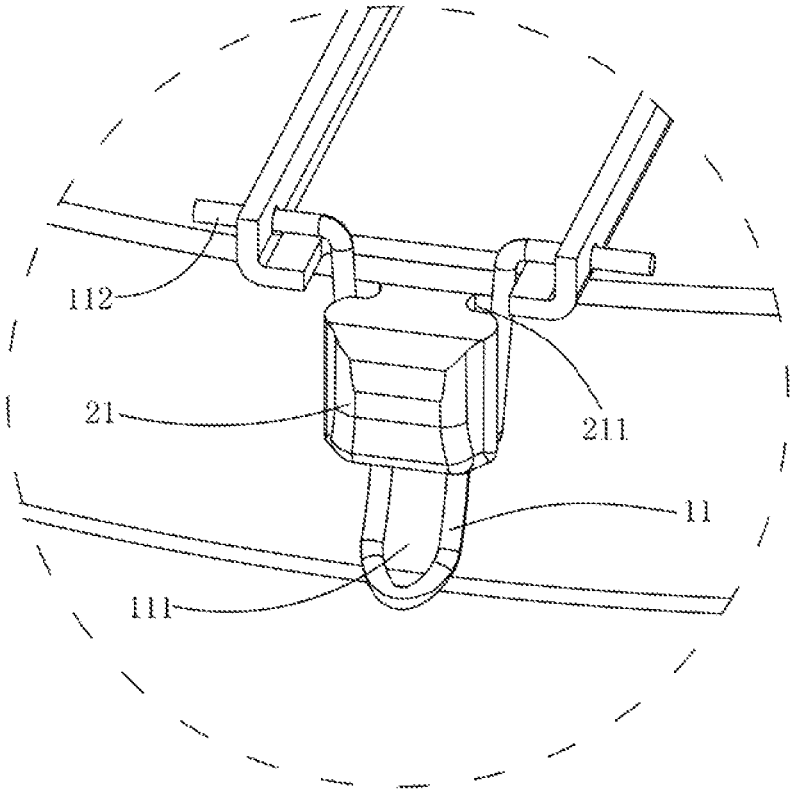
FIG. 4 is a locally enlarged view showing connection of one of the two retaining members and one of the two connecting portions.
Figure 5:
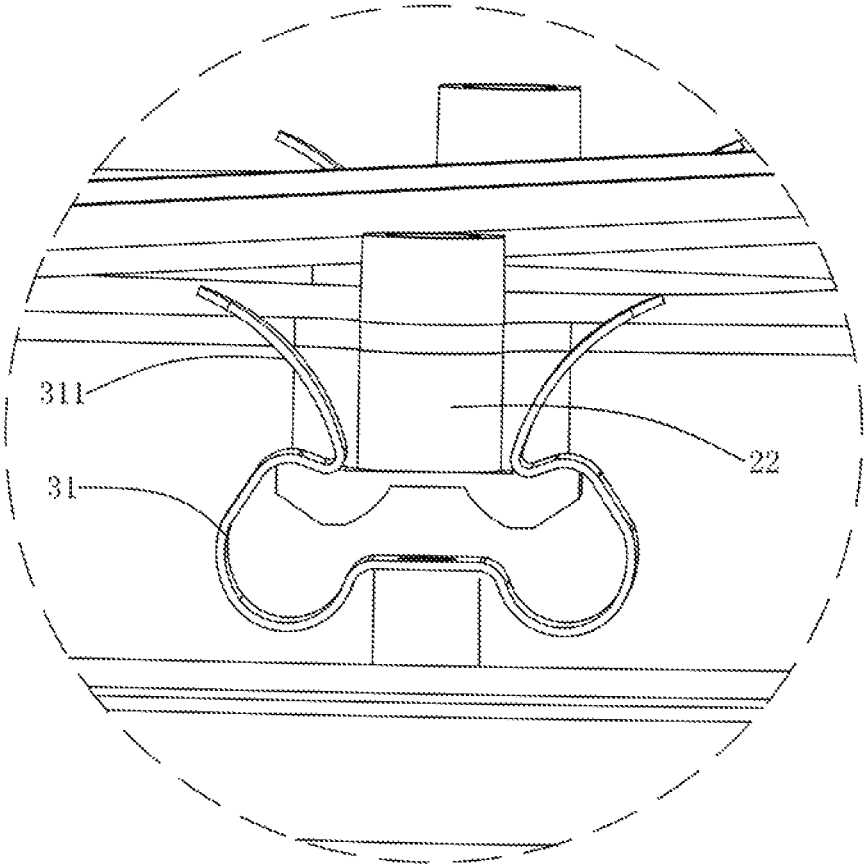
FIG. 5 is a locally enlarged view showing connection of one of the elastic plates and one of the locking members.

Referring to FIGS. 1-5, a ceiling light fixture in accordance with the preferred embodiment of the present invention comprises a mounting bracket 10, two retaining members 11 mounted on two ends of the mounting bracket 10 respectively, a light module 20 mounted on the mounting bracket 10, and an outer disk (or cover or ring) 30 mounted on the light module 20.

The mounting bracket 10 is a straight sheet plate. Each of the two retaining members 11 is pivotally connected with the mounting bracket 10. Each of the two retaining members 11 is rotated about the mounting bracket 10.

The light module 20 is retained by the two retaining members 11. The light module 20 has a periphery provided with two connecting portions 21 corresponding to the two retaining members 11 respectively. Each of the two connecting portions 21 of the light module 20 is provided with two retaining grooves 211 locked onto one of the two retaining members 11, such that each of the two connecting portions 21 of the light module 20 is secured to each of the two retaining members 11, and the light module 20 is secured to the mounting bracket 10. The two retaining grooves 211 of the light module 20 are formed on two opposite sides of each of the two connecting portions 21. The periphery of the light module 20 is further provided with a plurality of locking members 22.

The outer disk 30 is provided with a plurality of elastic plates 31 corresponding to the locking members 22 of the light module 20 respectively. Each of the elastic plates 31 of the outer disk 30 is locked onto one of the locking members 22 of the light module 20, such that the outer disk 30 is secured to the light module 20.

In the preferred embodiment of the present invention, the mounting bracket 10 is provided with a transverse channel 12 which extends through a whole length of the mounting bracket 10. Each of the two ends of the mounting bracket 10 is provided with two through holes. The two through holes of the mounting bracket 10 are formed on two sidewalls of the transverse channel 12.

In the preferred embodiment of the present invention, each of the two retaining members 11 is elastic and flexible, and has an inverted U-shaped configuration.

In the preferred embodiment of the present invention, each of the two retaining members 11 is provided with two hooked portions 112 inserted into and pivotally mounted in the two through holes of the mounting bracket 10 respectively, such that each of the two retaining members 11 is pivoted relative to the mounting bracket 10. The two hooked portions 112 are formed on two distal ends of each of the two retaining members 11.

In the preferred embodiment of the present invention, each of the two retaining members 11 is provided with a locking groove 111 locked onto one of the two connecting portions 21 of the light module 20. The locking groove 111 of each of the two retaining members 11 has a tapered shape and has a width gradually decreased from top to bottom. In practice, when one of the two connecting portions 21 of the light module 20 is locked in the locking groove 111 of one of the two retaining members 11, the light module 20 is hung on the ceiling, to facilitate the operator connecting electric lines.

In the preferred embodiment of the present invention, each of the elastic plates 31 of the outer disk 30 has two distal ends each formed with an arcuate guide portion 311 pressing one of the locking members 22 of the light module 20. Thus, each of the elastic plates 31 of the outer disk 30 is locked onto one of the locking members 22 of the light module 20 by guidance of the arcuate guide portion 311.

In the preferred embodiment of the present invention, each of the two retaining grooves 211 of the light module 20 has a side provided with an arcuate guide face, and each of the two retaining members 11 is guided by the arcuate guide face into each of the two retaining grooves 211 of the light module 20.

In the preferred embodiment of the present invention, the outer disk 30 is provided with a central hole, and the light module 20 is surrounded by the outer disk 30 and protrudes outward from the central hole of the outer disk 30.

In the preferred embodiment of the present invention, each of the locking members 22 of the light module 20 includes two sets which have different height, and are arranged and distributed alternately. Thus, after each of the elastic plates 31 of the outer disk 30 is locked onto one set of each of the locking members 22, the other set of each of the locking members 22 is locked in a gap defined between the ceiling light fixture and the ceiling.

In the preferred embodiment of the present invention, the outer disk 30 is provided with a plurality of support posts, and the elastic plates 31 are soldered on the support posts respectively.

In assembly, the two hooked portions 112 of each of the two retaining members 11 are inserted into the two through holes of the mounting bracket 10 respectively, such that each of the two retaining members 11 is pivotally connected with the mounting bracket 10. Then, one of the two connecting portions 21 of the light module 20 is arranged to correspond to one of the two retaining members 11. Then, one of the two retaining members 11 is pressed toward one of the two connecting portions 21, such that one of the two retaining members 11 is locked in the two retaining grooves 211 of one of the two connecting portions 21. Then, the other one of the two connecting portions 21 of the light module 20 is arranged to correspond to the other one of the two retaining members 11. Then, the other one of the two retaining members 11 is pressed toward one of the two connecting portions 21, such that the other one of the two retaining members 11 is locked in the two retaining grooves 211 of the other one of the two connecting portions 21. At this time, the light module 20 is drawn downward by its gravity, such that each of the two connecting portions 21 of the light module 20 is locked in the locking groove 111 of each of the two retaining members 11. In such a manner, the light module 20 is secured to the mounting bracket 10. Then, the outer disk 30 is pressed toward the light module 20, such that each of the elastic plates 31 of the outer disk 30 is locked onto each of the locking members 22 of the light module 20 by guidance of the arcuate guide portion 311, and the outer disk 30 is affixed to the light module 20. Thus, the mounting bracket 10 is attached to the ceiling, the light module 20 is secured to the mounting bracket 10, and the outer disk 30 is affixed to the light module 20, thereby finishing assembly of the ceiling light fixture.

On the contrary, when the operator wishes to disassemble the ceiling light fixture, the outer disk 30 is pulled downward to detach each of the elastic plates 31 of the outer disk 30 from each of the locking members 22 of the light module 20, such that the outer disk 30 is removed from the light module 20. Then, the light module 20 is pushed upward such that each of the two connecting portions 21 of the light module 20 is moved upward and unlocked from the locking groove 111 of each of the two retaining members 11. Then, each of the two retaining members 11 is pulled and pivoted outward relative to each of the two connecting portions 21, such that each of the two retaining members 11 is unlocked from the two retaining grooves 211 of each of the two connecting portions 21. In such a manner, each of the two retaining members 11 is detached from each of the two connecting portions 21, such that the light module 20 is removed from the mounting bracket 10. Thus, the outer disk 30 is removed from the light module 20, and the light module 20 is removed from the mounting bracket 10, thereby finishing disassembly of the ceiling light fixture.

Accordingly, the light module 20 is secured to the mounting bracket 10, and the outer disk 30 is affixed to the light module 20 to finish assembly of the ceiling light fixture, such that the ceiling will not be damaged during installation of the ceiling light fixture. In addition, the ceiling light fixture is assembled and disassembled easily and conveniently, thereby facilitating the operator assembling and disassembling the ceiling light fixture. Further, the ceiling light fixture is mounted on the ceiling easily and quickly, thereby decreasing the working time of installation. Further, the ceiling light fixture has a simplified construction, thereby decreasing the cost of fabrication and production.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling light fixture comprising:

a mounting bracket;

two retaining members mounted on two ends of the mounting bracket respectively;

a light module mounted on the mounting bracket; and an outer disk mounted on the light module;

wherein:

each of the two retaining members is pivotally connected with the mounting bracket;

each of the two retaining members is rotated about the mounting bracket;

the light module is retained by the two retaining members;

the light module has a periphery provided with two connecting portions corresponding to the two retaining members respectively;

each of the two connecting portions of the light module is provided with two retaining grooves locked onto one of the two retaining members;

the periphery of the light module is further provided with a plurality of locking members;

the outer disk is provided with a plurality of elastic plates corresponding to the locking members of the light module respectively; and each of the elastic plates of the outer disk is locked onto one of the locking members of the light module.

2. The ceiling light fixture of claim 1, wherein:

the mounting bracket is provided with a transverse channel;

each of the two ends of the mounting bracket is provided with two through holes; and the two through holes of the mounting bracket are formed on two sidewalls of the transverse channel.

3. The ceiling light fixture of claim 2, wherein:

each of the two retaining members is provided with two hooked portions inserted into and pivotally mounted in the two through holes of the mounting bracket respectively;

the two hooked portions are formed on two distal ends of each of the two retaining members;

each of the two retaining members is provided with a locking groove locked onto one of the two connecting portions of the light module; and the locking groove of each of the two retaining members has a width gradually decreased from top to bottom.

4. The ceiling light fixture of claim 1, wherein each of the elastic plates of the outer disk has two distal ends each formed with an arcuate guide portion pressing one of the locking members of the light module.

5. The ceiling light fixture of claim 1, wherein each of the locking members of the light module includes two sets which have different height, and are arranged and distributed alternately.

6. The ceiling light fixture of claim 1, wherein each of the two retaining members has an inverted U-shaped configuration.

* * * * *